US008203379B2

(12) United States Patent
Chen et al.

(10) Patent No.: US 8,203,379 B2
(45) Date of Patent: Jun. 19, 2012

(54) MIX MODE WIDE RANGE DIVIDER AND METHOD THEREOF

(75) Inventors: Yueh-Ming Chen, Taipei (TW); Isaac Y Chen, Jubei (TW); Shao-Hung Lu, Taoyuan (TW)

(73) Assignee: Richtek Technology Corp., Hsinchu (TW)

( * ) Notice: Subject to any disclaimer, the term of this patent is extended or adjusted under 35 U.S.C. 154(b) by 43 days.

(21) Appl. No.: 12/985,563

(22) Filed: Jan. 6, 2011

(65) Prior Publication Data

US 2011/0169473 A1 Jul. 14, 2011

(30) Foreign Application Priority Data

Jan. 11, 2010 (TW) ..... 99100521 A

(51) Int. Cl.
*G05F 3/02* (2006.01)

(52) U.S. Cl. ..... 327/538; 327/540; 327/541; 327/543

(58) Field of Classification Search ..... None
See application file for complete search history.

(56) References Cited

U.S. PATENT DOCUMENTS

| | | | | |
|---|---|---|---|---|
| 7,902,910 | B2 * | 3/2011 | Park et al. | 327/536 |
| 2009/0167423 | A1 * | 7/2009 | Chiu et al. | 327/543 |
| 2009/0296484 | A1 * | 12/2009 | Wang et al. | 365/185.18 |
| 2011/0101954 | A1 * | 5/2011 | Lu et al. | 323/313 |

* cited by examiner

*Primary Examiner* — Tuan T Lam
(74) *Attorney, Agent, or Firm* — Rosenberg, Klein & Lee

(57) ABSTRACT

A mix mode wide range divider is provided for dividing a first signal by a second signal to generate an output signal. A third signal is generated depending on the resistance of a first adjustable resistor, and a fourth signal is generated according to the third signal and a target value determined by the second signal, to adjust the resistance of the first adjustable resistor and the resistance of a second adjustable resistor. The resistance of the first adjustable resistor is so adjusted to make the third signal equal to the target value, and the resistance of the second adjustable resistor is so adjusted to maintain a ratio of the resistance of the second adjustable resistor to the resistance of the first adjustable resistor. The output signal is generated depending on the first signal and the resistance of the second adjustable resistor.

22 Claims, 6 Drawing Sheets

MIX MODE WIDE RANGE DIVIDER AND METHOD THEREOF

FIELD OF THE INVENTION

The present invention is related generally to a divider and, more particularly, a mix mode wide range divider.

BACKGROUND OF THE INVENTION

The conventional analog divider is constructed from MOSFETs and operates with the MOSFETs in their triode region, and thus only accepts the input signals limited within a certain range, making it only suitable for AC small signal applications. For DC large signal applications, the digital divider is usually used instead. However, the digital divider is disadvantageous because it requires greater space on a chip.

To improve the input range of the analog divider, as shown in FIG. 1, capacitors C1 and C2 are employed at the inputs of the analog divider, whose waveform diagram is shown in FIG. 2. In this analog divider, the input signals are currents id and in and are applied to the capacitors C1 and C2 to charge thereto to generate voltages Vc1 and Vc2, respectively, a signal Reset controls a switch M1 shunt to the capacitor C1, and a comparator 10 compares the voltage Vc1 with a threshold voltage Vth to generate a comparison signal VT to control a switch M2 shunt to the capacitor C2. With the signal Reset to switch the switch M1, the capacitor C1 is charged or reset to control the voltage Vc1. As shown in FIG. 2, at time t1, the voltage Vc1 increases to the threshold voltage Vth and thus turns on the comparison signal VT to turn on the switch M2 to reset the capacitor C2. At time t2, the signal Reset turns on the switch M1 to reset the capacitor C1 and thus turns off the comparison signal VT to turn off the switch M2, from which the voltage Vc2 increases until next time the voltage Vc1 becomes greater than the threshold voltage Vth. Assuming that the signal Reset has a pulse width TR, the comparison signal VT has an off time Td, and TR<<Td, referring to FIGS. 1 and 2, the capacitor C1 will be charged with a charging time $$Tcharge=Td-TR=C1\times Vth/id, \quad \text{[Eq-1]}$$

from which it is derived the off time $$Td=(C1\times Vth/id)+TR. \quad \text{[Eq-2]}$$

Therefore, the voltage Vc2 will have a peak value $$Vc2_peak=Td\times in/C2. \quad \text{[Eq-3]}$$

By applying the equation Eq-2 to the equation Eq-3, it is obtained the peak value $$Vc2_peak(C1\times Vth/C2)\times in/id, \quad \text{[Eq-4]}$$

which shows that the peak value Vc2_peak of the voltage Vc2 is almost in direct proportion to the ratio in/id. In other words, the peak value Vc2_peak of the voltage Vc2 includes the information of the value produced by dividing the current in by the current id. Therefore, a peak detector is required to detect the peak value Vc2_peak of the voltage Vc2 for this divider. However, a general peak detector is constructed by a diode-capacitor network, and thus may fail to work if the input currents id and in are too small to produce a sufficient voltage Vc2. Alternatively, a peak detector may be implemented with sampling and holding circuit; however, it requires additional time for sampling and is thus unable to have instant response.

On the other hand, when the analog divider of FIG. 1 is just after startup or suffers any input transient, as shown in FIG. 2, it requires a delay time Tdelay for the capacitors C1 and C2 to be reset before they are recharged to produce the proper peak value Vc2_peak of the voltage Vc2, and the delay time Tdelay may be as long as the period of the signal Reset. Therefore, the analog divider of FIG. 1 is not suitable to applications where rapid response is needed.

Therefore, it is desired a wide range and fast response divider.

SUMMARY OF THE INVENTION

An object of the present invention is to provide a mix mode divider and method with combined analogy and digital circuits.

Another object of the present invention is to provide a wide input range divider and method.

According to the present invention, a mix mode wide range divider for dividing a first signal by a second signal to generate an output signal includes two adjustable resistors, a control circuit to determine a third signal according to the resistance of the first adjustable resistor, a feedback circuit to generate a fourth signal according to the third signal and a target value determined by the second signal, and a digital circuit responsive to the fourth signal to adjust the resistance of the first adjustable resistor to make the third signal equal to the target value and to adjust the resistance of the second adjustable resistor to maintain a ratio of the resistance of the second adjustable resistor to the resistance of the first adjustable resistor.

According to the present invention, a method for dividing a first signal by a second signal to generate an output signal generates a third signal depending on a resistance of a first adjustable resistor, determines a target value depending on the second signal, generates a fourth signal according to the third signal and the target value, adjusts the resistance of the first adjustable resistor according to the fourth signal to make the third signal equal to the target value, adjusts a resistance of a second adjustable resistor to maintain a ratio of the resistance of the second adjustable resistor to the resistance of the first adjustable resistor, and generates the output signal depending on the resistance of the second adjustable resistor and the first signal.

BRIEF DESCRIPTION OF THE DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

Figure 1:
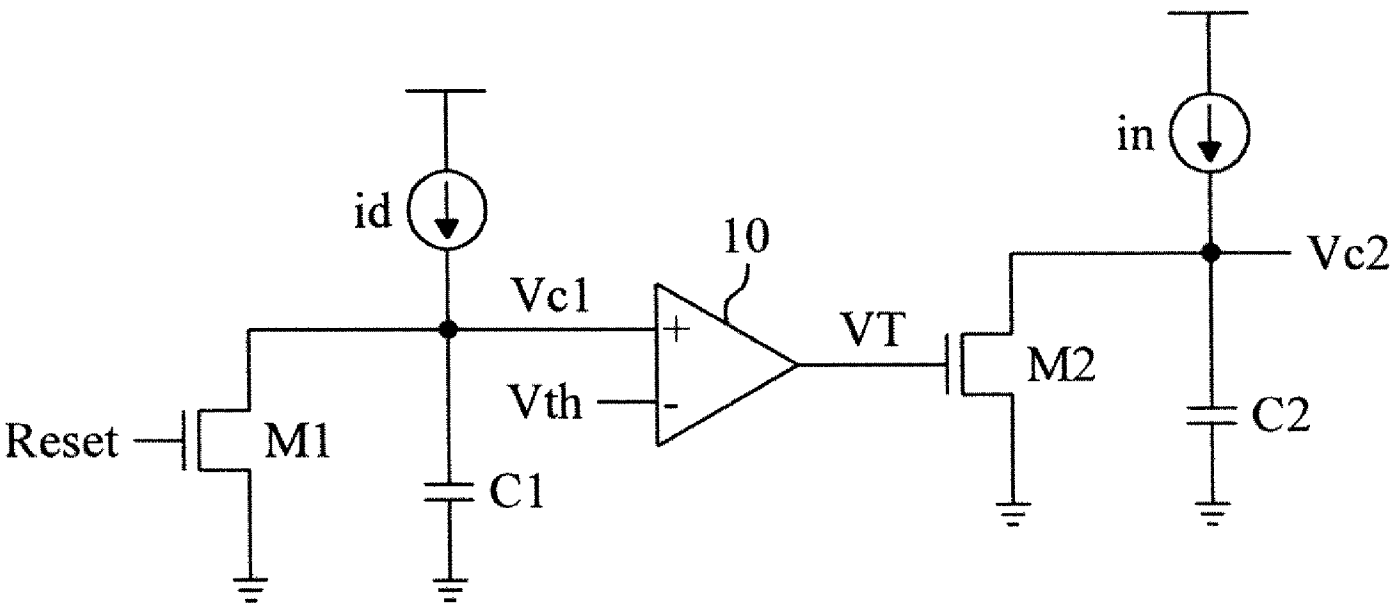
Fig. 1 Prior Art
FIG. 1 is a circuit diagram of a conventional analog current divider.
Figure 2:
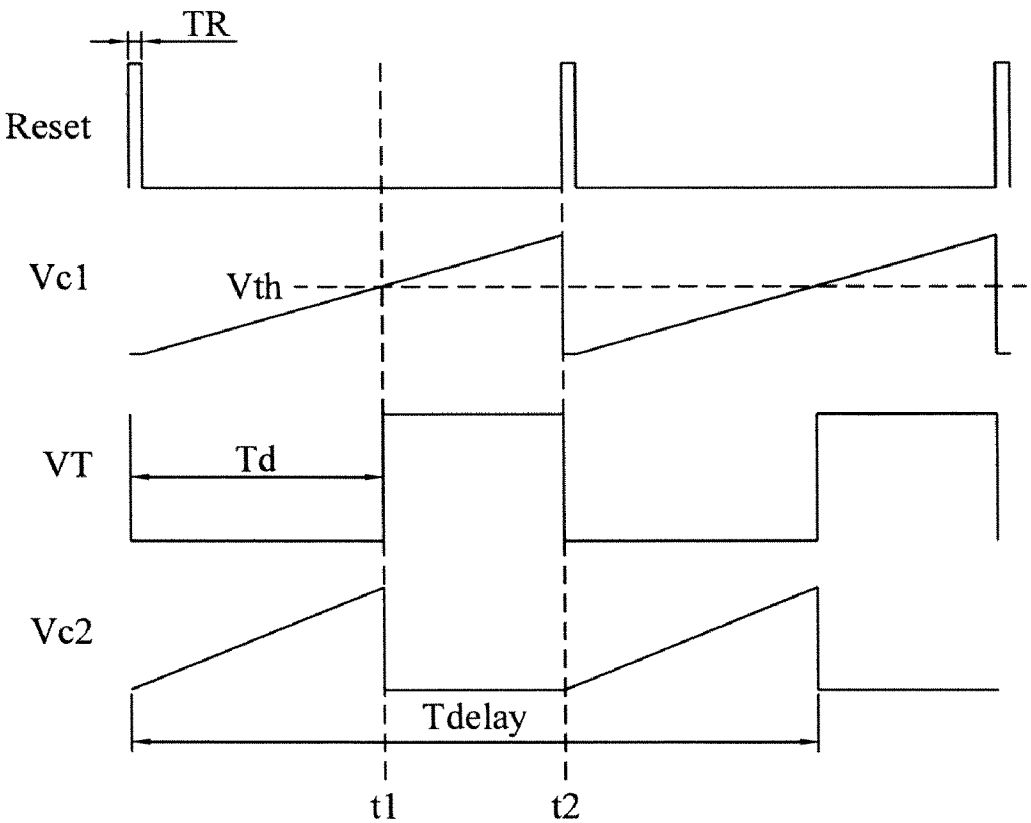
Fig. 2 Prior Art
FIG. 2 is a waveform diagram of the analog current divider shown in FIG. 1.
Figure 3:
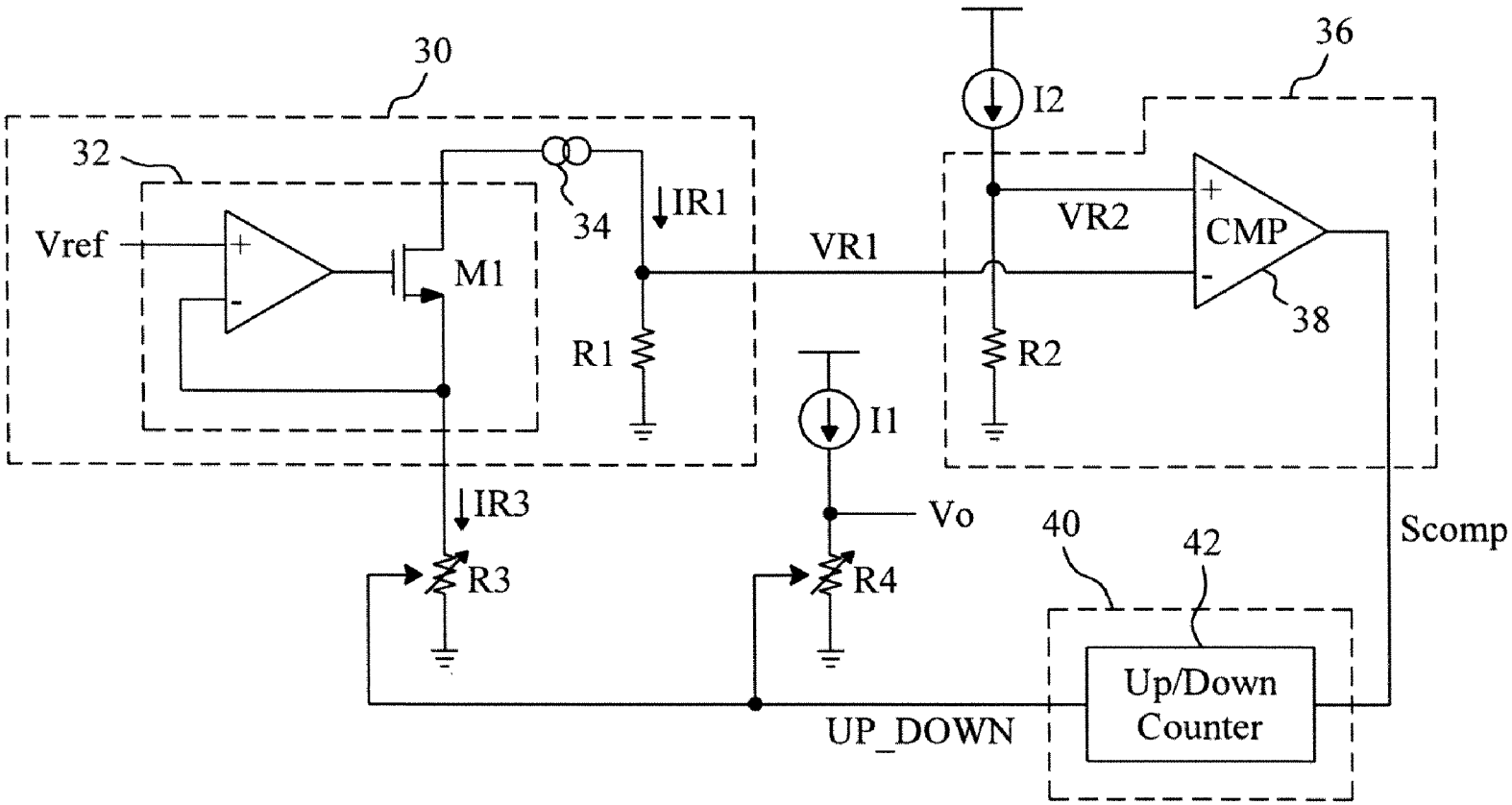
FIG. 3 is a circuit diagram of a current divider according to the present invention.

FIG. 3 is a circuit diagram of a first embodiment according to the present invention, for dividing a first input current I1 by a second input current I2 to generate an output voltage Vo, in which a control circuit 30 has a voltage source 32 applying a reference voltage Vref to a first adjustable resistor R3 to generate a first current IR3, a current mirror 34 mirroring the first current IR3 to generate a second current IR1, and a resistor R1 receiving the second current IR1 to generate a voltage VR1, a feedback circuit 36 has a resistor R2 receiving the second input current I2 to set a target value VR2, and a comparator 38 comparing the voltage VR1 with the target value VR2 to generate a comparison signal Scomp, a digital circuit 40 has an up/down counter 42 to generate a digital signal UP_DOWN according to the comparison signal Scomp to adjust the resistances of the first and second adjustable resistors R3 and R4, and the second adjustable resistor R4 receives the first input current I1 to generate the output voltage Vo. By the feedback loop, the digital signal UP_DOWN will adjust the resistance of the first adjustable resistor R3 such that the voltage VR1 will be equal to the target value VR2. On the other hand, the digital signal UP_DOWN will adjust the resistance of the second adjustable resistor R4 to maintain the resistance of the second adjustable resistor R4 equal to the resistance of the first adjustable resistor R3, or to maintain the ratio of the resistance of the second adjustable resistor R4 to the resistance of the first adjustable resistor R3. In an embodiment, it is set that R1=R2, IR1=IR3, and the adjustable resistors R3 and R4 are adjusted to maintain R3=R4. In steady state, VR1=VR2, and since VR1=IR1×R1=IR3×R2=(Vref/R3)×R2 and VR2=I2×R2, it will obtain $$R3=Vref/I2=R4, \quad \text{[Eq-5]}$$

and the output voltage $$\begin{aligned} Vo &= I1\times R4 \quad \text{[Eq-6]} \\ &= I1\times(Vref/I2) \\ &= Vref\times(I1/I2). \end{aligned}$$

According to the equation Eq-6, the output voltage Vo includes the information of the value produced by dividing the first input current I1 by the second input current I2.

Figure 4:
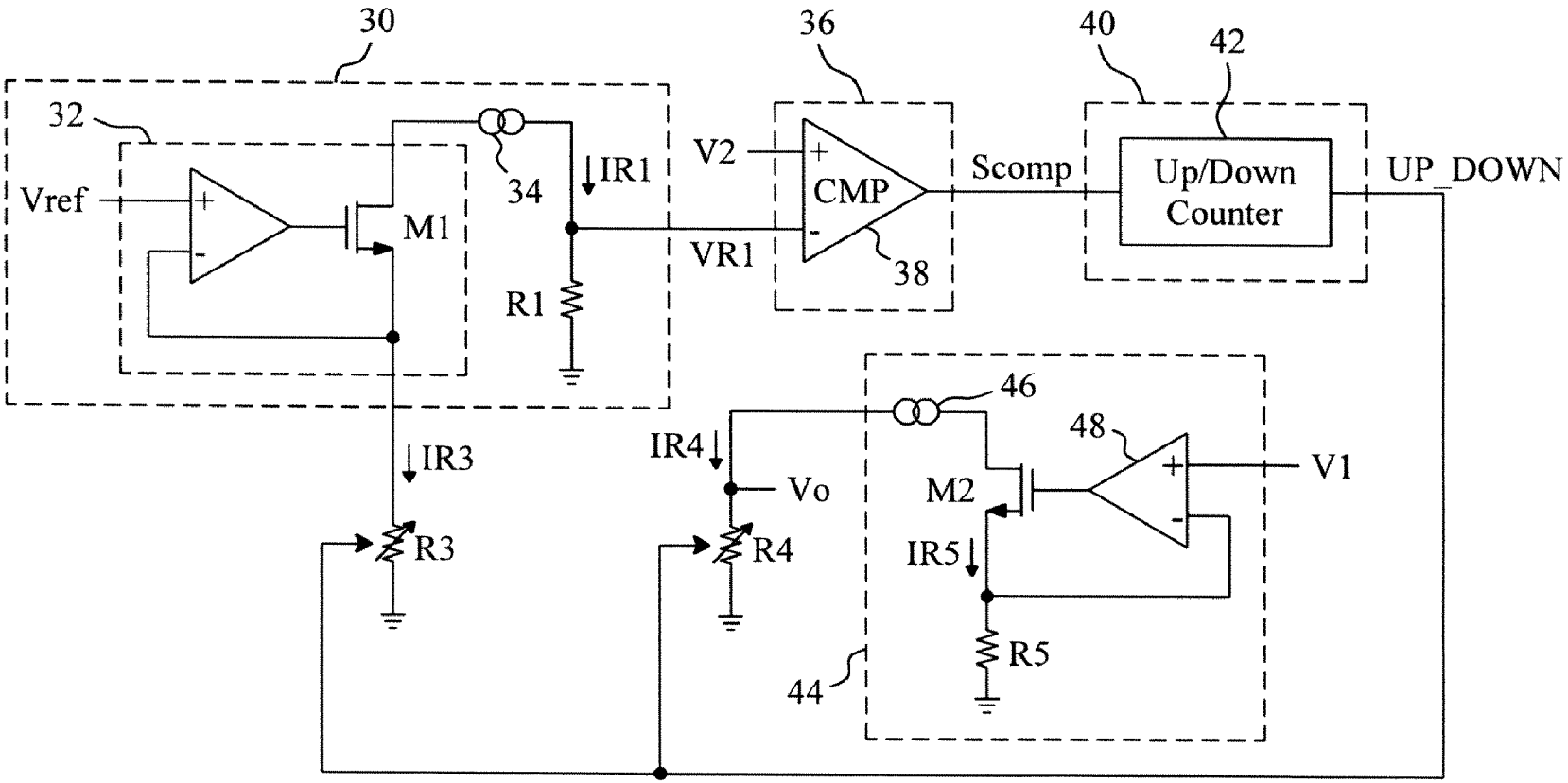
FIG. 4 is a circuit diagram of a voltage divider according to the present invention.

FIG. 4 is a circuit diagram of a second embodiment according to the present invention, for dividing a first input voltage V1 by a second input voltage V2 to generate an output voltage Vo, in which the first and second adjustable resistors R3 and R4, the control circuit 30 and the digital circuit 40 are the same as that of FIG. 3, while the feedback circuit 36 is modified to use the second input voltage V2 as the target value compared with the voltage VR1 by the comparator 38 to generate the comparison signal Scomp, and a voltage-current converter 44 is added to convert the first input voltage V1 into a current IR4 applied to the second adjustable resistor R4 to generate the output voltage Vo. In the voltage-current converter 44, an operational amplifier 48 has a positive input receiving the first input voltage V1, a negative input coupled to a resistor R5, and an output coupled to a gate of a MOSFET M2, due to virtual short circuit between the inputs of the operational amplifier 48, the first input voltage V1 is applied to the resistor R5 to generate a current $$IR5=V1/R5, \quad \text{[Eq-7]}$$

and a current mirror 46 mirrors the current IR5 to generate the current IR4. In an embodiment, it is set that IR1=IR3, IR4=IR5, and the adjustable resistors R3 and R4 are adjusted to maintain R3=R4. In steady state, VR1=V2, and since VR1=IR1×R1=IR3×R1=(Vref/R3)×R1 and IR4=IR5=V1/R5, it will obtain $$R3=(Vref/V2)\times R1=R4, \quad \text{[Eq-8]}$$

and the output voltage $$\begin{aligned} Vo &= IR4\times R4 \quad \text{[Eq-9]} \\ &= (V1/R5)\times[(Vref/V2)\times R1] \\ &= (Vref\times R1/R5)\times(V1/V2). \end{aligned}$$

According to the equation Eq-9, the output voltage Vo includes the information of the value produced by dividing the first input voltage V1 by the second input voltage V2.

Figure 5:
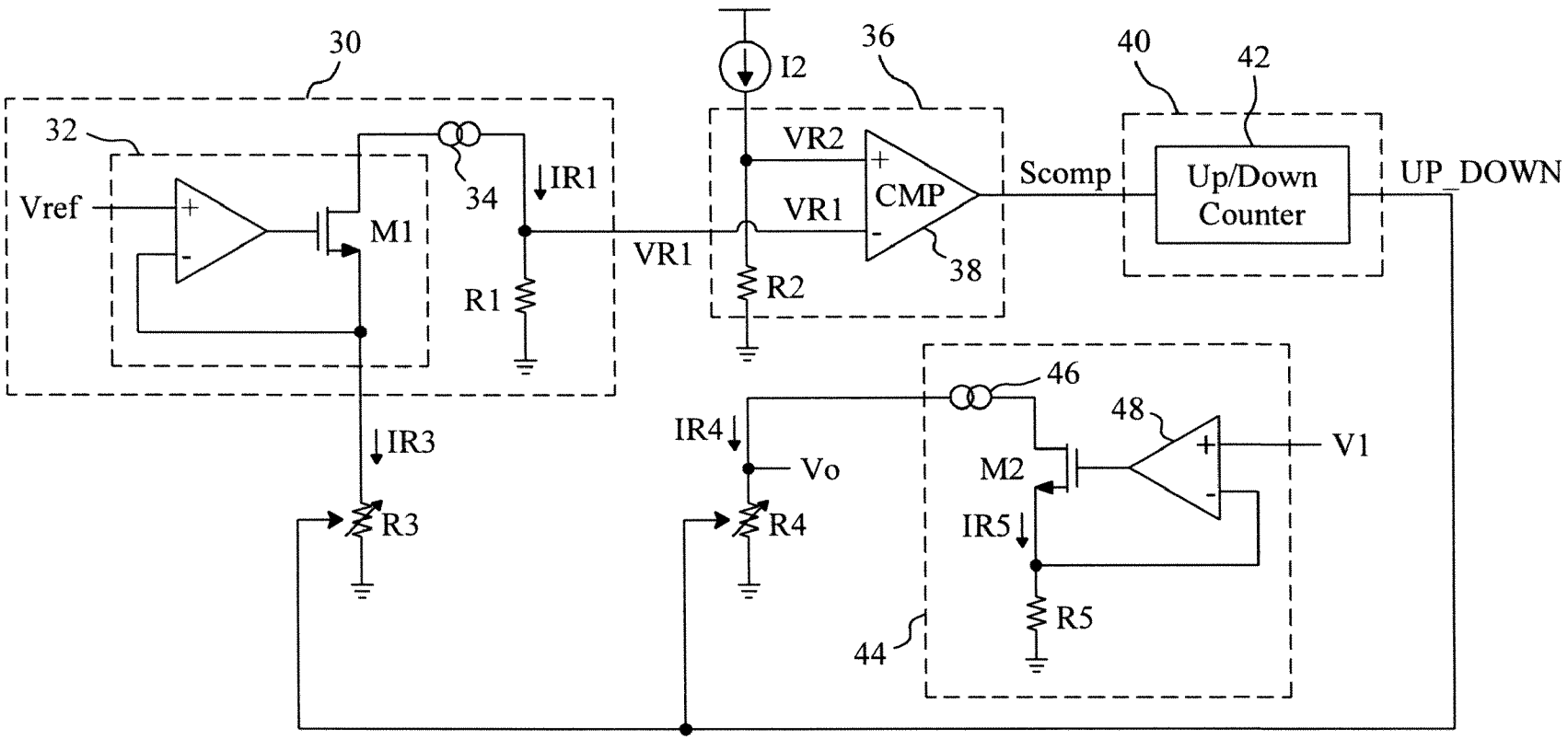
FIG. 5 is a circuit diagram of a voltage-current divider according to the present invention.

FIG. 5 is a circuit diagram of a third embodiment according to the present invention, for dividing an input voltage V1 by an input current I2 to generate an output voltage Vo, in which the first and second adjustable resistors R3 and R4, the control circuit 30, the feedback circuit 36 and the digital circuit 40 are the same as that of FIG. 3, and the voltage-current converter 44 is the same as that of FIG. 4. In an embodiment, it is set that R1=R2, IR1=IR3, IR4=IR5, and the adjustable resistors R3 and R4 are adjusted to maintain R3=R4. In steady state, VR1=VR2, and according to the equation Eq-5, it will obtain the output voltage $$\begin{aligned} Vo &= IR4\times R4 \quad \text{[Eq-10]} \\ &= IR5\times(Vref/I2) \\ &= (V1/R5)\times(Vref/I2) \\ &= (Vref/R5)\times(V1/I2). \end{aligned}$$

According to the equation Eq-10, the output voltage Vo includes the information of the value produced by dividing the input voltage V1 by the input current I2.

Figure 6:
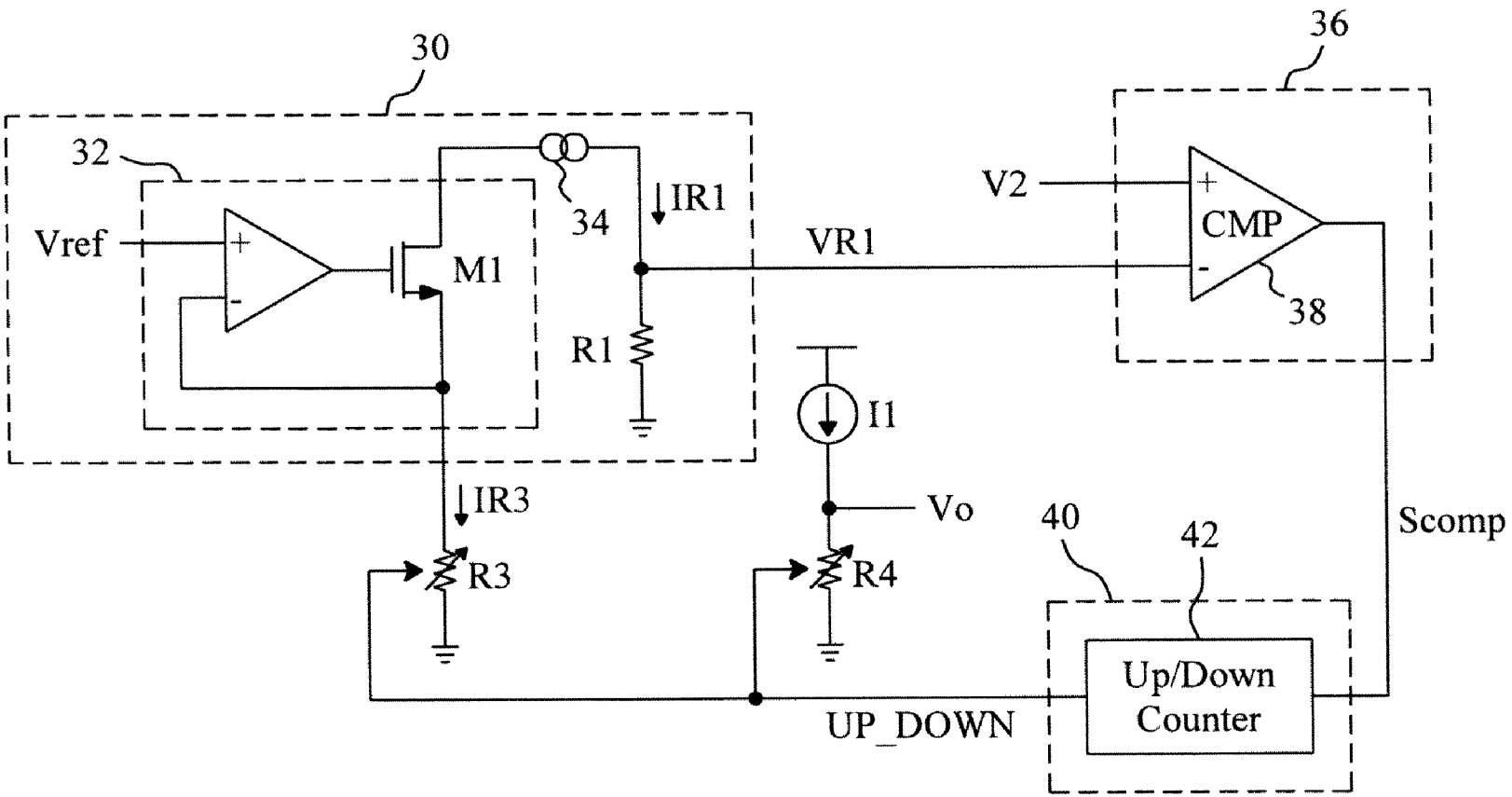
FIG. 6 is a circuit diagram of a current-voltage divider according to the present invention.

FIG. 6 is a circuit diagram of a fourth embodiment according to the present invention, for dividing an input current I1 by an input voltage V2 to generate an output voltage Vo, in which the first and second adjustable resistors R3 and R4, the control circuit 30, the feedback circuit 36 and the digital circuit 40 are the same as that of FIG. 4. In an embodiment, it is set that IR1=IR3, and the adjustable resistors R3 and R4 are adjusted to maintain R3=R4. In steady state, VR1=V2 and thus the output voltage $$\begin{aligned} Vo &= I1\times R4 \quad \text{[Eq-11]} \\ &= I1\times R3 \\ &= I1\times(Vref/IR3) \\ &= I1\times(Vref/IR1) \\ &= I1\times[Vref/(VR1/R1)] \\ &= I1\times[Vref/(V2/R1)] \\ &= I1\times[(Vref/V2)\times R1] \\ &= (Vref\times R1)\times(I1/V2). \end{aligned}$$

According to the equation Eq-11, the output signal Vo includes the information of the value produced by dividing the input current I1 by the input voltage V2.

According to the present invention, a divider is designed based on the Ohm's law, using a resistor to convert the input voltage or the input current into a current or a voltage, for producing the output signal Vo, and is thus not limited in its input range, while has simpler circuit that is easier to implement. Moreover, the up/down counter 42 may store values of the adjusted resistances of the adjustable resistors R3 and R4, so that when input transient occurs, the up/down counter 42 may instantly adjust the resistances of the adjustable resistors R3 and R4 to align the last adjustment according to the data it stores. Thus, it eliminates the need of adjusting from the very beginning, thereby allowing rapid transient response.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A mix mode wide range divider for dividing a first signal by a second signal to generate an output signal, comprising:
- a first adjustable resistor having a first resistance;
- a second adjustable resistor having a second resistance in proportion to the first resistance, configured to generate the output signal according to the first signal;
- a control circuit coupled to the first adjustable resistor, operative to determine a third signal according to the first resistance;
- a feedback circuit coupled to the control circuit, configured to generate a fourth signal according to the third signal and a target value determined by the second signal; and
- a digital circuit coupled to the feedback circuit, the first and second adjustable resistors, responsive to the fourth signal to adjust the first resistance to make the third signal equal to the target value, and to adjust the second resistance to maintain a ratio of the second resistance to the first resistance.

2. The mix mode wide range divider of claim 1, wherein the control circuit comprises:
- a voltage source coupled to the first adjustable resistor, applying a reference voltage to the first adjustable resistor to generate a first current;
- a current mirror coupled to the first adjustable resistor, mirroring the first current to generate a second current; and
- a resistor coupled to the current mirror, receiving the second current to generate the third signal.

3. The mix mode wide range divider of claim 1, wherein the first signal is proportional to a first current and the second signal is proportional to a second current.

4. The mix mode wide range divider of claim 3, wherein the feedback circuit comprises:
- a setting resistor receiving the second current to determine the target value; and
- a comparator coupled to the setting resistor and the control circuit, comparing the third signal with the target value to generate the fourth signal.

5. The mix mode wide range divider of claim 3, wherein the second adjustable resistor receives the first current to generate the output signal.

6. The mix mode wide range divider of claim 1, wherein the first signal is proportional to a first voltage and the second signal is proportional to a second voltage.

7. The mix mode wide range divider of claim 6, wherein the feedback circuit comprises a comparator comparing the third signal with the second voltage to generate the fourth signal.

8. The mix mode wide range divider of claim 6, further comprising a voltage-current converter converting the first voltage into a current applied to the second adjustable resistor to generate the output signal.

9. The mix mode wide range divider of claim 1, wherein the first signal is proportional to a voltage and the second signal is proportional to a current.

10. The mix mode wide range divider of claim 9, wherein the feedback circuit comprises:
- a setting resistor receiving the current to determine the target value; and
- a comparator coupled to the setting resistor and the control circuit, comparing the third signal with the target value to generate the fourth signal.

11. The mix mode wide range divider of claim 9, further comprising a voltage-current converter converting the voltage into a second current applied to the second adjustable resistor to generate the output signal.

12. The mix mode wide range divider of claim 1, wherein the first signal is proportional to a current and the second signal is proportional to a voltage.

13. The mix mode wide range divider of claim 12, wherein the feedback circuit comprises a comparator comparing the third signal with the voltage to generate the fourth signal.

14. The mix mode wide range divider of claim 12, wherein the second adjustable resistor receives the current to generate the output signal.

15. The mix mode wide range divider of claim 1, wherein the digital circuit comprises an up/down counter responsive to the fourth signal to adjust the first and second resistances.

16. The mix mode wide range divider of claim 1, wherein the digital circuit stores values representative of the first and second resistances.

17. A method for dividing a first signal by a second signal to generate an output signal, comprising the steps of:
- A.) generating a third signal depending on a resistance of a first adjustable resistor;
- B.) determining a target value depending on the second signal;
- C.) generating a fourth signal according to the third signal and the target value;
- D.) responsive to the fourth signal, adjusting the resistance of the first adjustable resistor to make the third signal equal to the target value, and adjusting a resistance of a second adjustable resistor to maintain a ratio of the resistance of the second adjustable resistor to the resistance of the first adjustable resistor; and
- E.) generating the output signal depending on the resistance of the second adjustable resistor and the first signal.

18. The method of claim 17, wherein the step A comprises the steps of:
- applying a reference voltage to the first adjustable resistor to generate a first current;
- mirroring the first current to generate a second current applied to a setting resistor to generate the third signal.

19. The method of claim 17, wherein the step B comprises the step of applying a current proportional to the second signal to a setting resistor to determine the target value.

20. The method of claim 17, wherein the step C comprises the step of comparing the third signal with the target value to generate the fourth signal.

21. The method of claim 17, wherein the step E comprises the step of applying a current proportional to the first signal to the second adjustable resistor to generate the output signal.

22. The method of claim 17, further comprising the step of storing values representative of the resistances of the first and second adjustable resistors.

* * * * *